United States Patent [19]

Norton

[11] Patent Number: 4,690,074

[45] Date of Patent: Sep. 1, 1987

[54] COAL COMBUSTION SYSTEM

[76] Inventor: Charles L. Norton, 8669 White Oak Ave., Munster, Ind. 46321

[21] Appl. No.: 859,138

[22] Filed: May 2, 1986

[51] Int. Cl.[4] ..... F23D 1/02

[52] U.S. Cl. ..... 110/264; 110/347; 431/185

[58] Field of Search ..... 110/264, 265, 347; 431/182–185

[56] References Cited

U.S. PATENT DOCUMENTS

| | | | |
|---|---|---|---|
| 4,270,895 | 6/1981 | Vatsky | 110/264 X |
| 4,457,695 | 7/1984 | Kummel | 110/264 X |
| 4,523,530 | 6/1985 | Kaminaka et al. | 110/264 |

*Primary Examiner*—Edward G. Favors

*Attorney, Agent, or Firm*—Marshall, O'Toole, Gerstein, Murray & Bicknell

[57] ABSTRACT

A coal combustion control system is provided with independent means for supplying primary air and secondary air to a burner pipe assembly having a longitudinal central conduit through which pulverized coal suspended in primary air passes. Surrounding the central section is a first annular conduit through which secondary air is supplied, the secondary air passing through a spinner section near the outlet end of the annulus which imparts turbulence to the secondary air flow. In a preferred embodiment, a second annular conduit conveys a portion of the secondary air without spinners and turbulence. The relative quantities of air passing through the first annular, spinning or turbulent, zone and the second annular, straight or non-turbulent, zone can be regulated to obtain the desired flame characteristics and flame length appropriate for a given use of the coal burning system.

6 Claims, 12 Drawing Figures

COAL COMBUSTION SYSTEM

The present invention relates to an improved system for the continuous combustion of pulverized coal and more particularly to such a system employing independently controllable means for supplying heated secondary air to a burner pipe used in the system.

BACKGROUND OF THE INVENTION

Although the use of coal as a source of heat in pyroprocessing industries and electrical utilities has increased as a result of the increasing price and limited availability of oil and gas, very little effort has been expended to improve the combustion technology of this fuel. A typical system for burning coal, other than stoker firing, consists of a mill for grinding the coal to relatively small particle size, and a straight burner pipe into which the pulverized coal is introduced in a stream of air, the exit end of the burner pipe emitting the coal and air into a combustion chamber where firing occurs. In general, there are three basic methods of firing coal in this manner: direct fired, wherein the pulverized coal suspended in a stream of air (primary air) from the coal grinding mill passes through a burner pipe into the combustion chamber; semi-direct fired, wherein pulverized coal is removed from the mill airstream and is reinjected into the combustion chamber on a continuous basis; and indirect fired, wherein pulverized coal is collected from the mill airstream into storage, from which it is injected into the combustion chamber. In any of these coal firing methods, the coal is conventionally introduced into the combustion chamber through a straight pipe and suspended in a stream of "primary air".

In order to achieve the turbulence necessary for good combustion in the combustion chamber, it has been conventional to produce a high velocity air flow through the straight pipe, with consequent high pressure drop losses in the fan circuit supplying the stream of primary air from the coal mill. The requirement that the coal mill fan must create a high velocity flow through the burner pipe interferes with the efficiency of the coal mill fan, since the fan is being operated primarily for its effect on the burning of the coal in the combustion chamber, rather than for its primary function of providing proper air flow through the coal mill and coal classifier. In addition, the high velocity used to produce desirable turbulence in the combustion zone causes the coal particles to pass through the combustion zone before they can make effective contact with oxygen, thereby leaving some of the coal feed unburned.

There have been some efforts to achieve turbulence in the combustion zone by means other than a high velocity of the inlet coal particles, principally by swirlers placed in the burner pipe to create turbulence in the air stream. One such prior system involves the injection of preheated air directly into the primary burner pipe. This system created a problem with the operation of the coal mill in direct fired systems because the increase in static pressure in the burner pipe, resulting from the injected preheated air, could not be handled by the coal mill fan.

Another prior system included a burner that took a portion of air and coal from the coal transport pipe, removed the coal from the air by means of a cyclone and then returned the air to the burner tip at low temperature. This system was restricted in that the quantity and temperature of air it could utilize for controlling the flame was very limited. The system could handle only a portion of the already low air flow that the coal mill fan could deliver. It also lacked precise control of the limited air flow to the burner tip, and offered no source of high temperature to create combustion conditions.

SUMMARY OF THE INVENTION

In accordance with the present invention, there is provided a coal combustion control system provided with independent means for supplying primary air and secondary air to a burner pipe assembly. In this context, "primary" air refers to the air stream in which the coal particles are suspended for introduction into the combustion zone through the burner pipe, while "secondary air" refers to the additional air needed for combustion and supplied independently of the primary air. The amount of primary air used in the system of the invention is controlled solely by the requirements for drying, preheating, grinding, classifying, and/or transporting the coal from a coal mill to the burner. The air required for the desired type of burning of the coal, i.e., neutral (stoichiometric), oxidizing, or reducing can be supplied by the secondary air system. In addition, the secondary air supply system is provided with means for producing turbulence in the secondary air flow in order to optimize the burning conditions at the outlet of the burner pipe.

In a typical embodiment, the burner pipe assembly used in the system of the invention comprises a longitudinal central conduit through which pulverized coal suspended in primary air passes. Surrounding the central section is a first annular conduit through which secondary air is supplied, the secondary air passing through a spinner section near the outlet end of the annulus which imparts turbulence to the secondary air flow. In a preferred embodiment, a second annular conduit conveys a portion of the secondary air without spinners and turbulence. The relative quantities of air passing through the first annular, spinning or turbulent, zone and the second annular, straight or non-turbulent, zone can be regulated to obtain the desired flame characteristics and flame length apropriate for a given use of the coal burning system.

An important feature of the control system of the invention is the ability, as desired, to introduce large quantities of hot air into the coal-rich stream as it enters the combustion zone, so that the pulverized coal particles can be rapidly heated sufficiently to be decomposed to gaseous carbon monoxide. If such decomposition is produced early enough in the flame zone, better mixing of the combustible gases and oxygen can be achieved well within the combustion zone, thus leading to more complete combustion with normally desirable low excess oxygen.

In the coal-burning systems heretofore known, the air supplied to the burner was typically all primary air, in which the pulverized coal was suspended. Although the amount of primary air could be controlled, its maximum temperature was limited to about 200° F. in order to avoid the possibility of premature combustion. By adding secondary air as a separate independently controllable stream to the burner pipe assembly, the control system of the invention permits the attainment of maximum efficiency under the combustion conditions desired within the combustion zone.

BRIEF DESCRIPTION OF THE DRAWINGS

The invention will be better understood from the detailed description which follows, taken in conjunction with the accompanying drawings, in which.

DESCRIPTION OF THE PREFERRED EMBODIMENT

Figure 1:
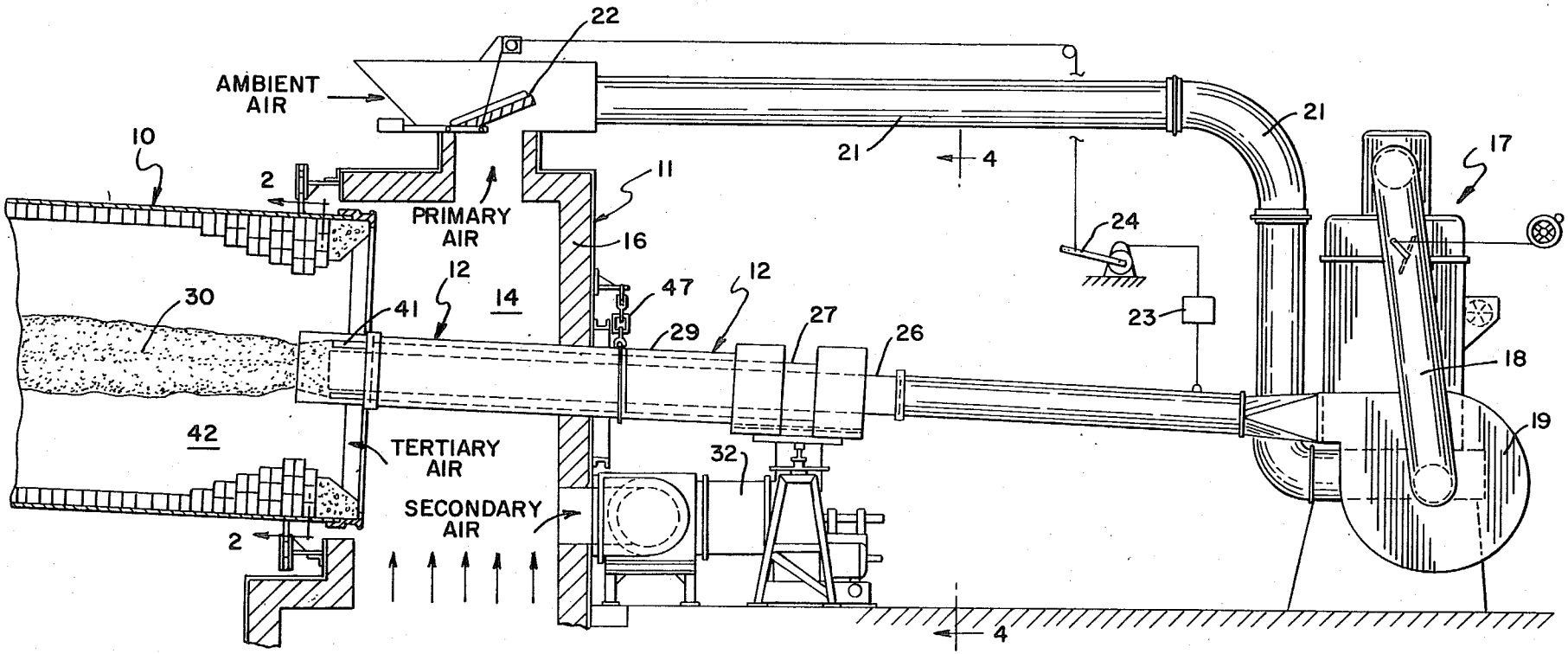
FIG. 1 is an elevation in partial section of the system of the invention as it might be used in a lime kiln.

In a typical embodiment, the system of the invention is used to heat a rotary kiln for the production of lime or cement, etc. As shown in FIG. 1, the exit end of kiln 10 is provided with a kiln hood or firing hood 11 through which a burner pipe assembly 12 passes, the exit end of the burner being situated within the exit end of the kiln. The heated product 13 (FIG. 2) exiting from the end of kiln 10 falls into a cooling section (not shown) where it is cooled by a stream of air travelling vertically, in the direction of the arrows shown in FIG. 1, within the conduit 14 defined by the exit end of kiln 10 and front wall 16 of the kiln hood. By reason of its contact with the heated product, the stream of cooling air reaches an elevated temperature typically within the range of 900°-1400° F.

Coal mill 17 supplies through coal feed conduit 18 pulverized coal in a stream of primary air to coal mill fan 19. Coal mill air is drawn through preheat duct 21 from a mixture of ambient air and heated air at the upper end of kiln hood 11. The relative proportions of ambient air and heated air are determined by the position of hood damper 22 which is controlled by temperature controller 23 and temperature control drive 24 to maintain in the entry to burner pipe assembly 12 a temperature within the range of about 180°-200° F. The relatively low temperature is required to prevent premature firing of the coal in the air stream entering the burner pipe.

Figure 5:
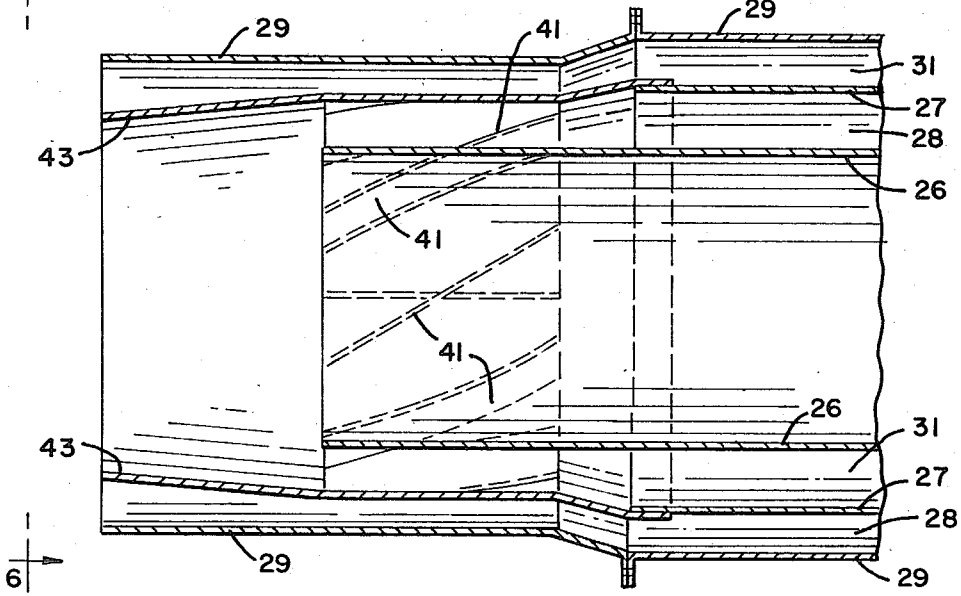
FIG. 5 is an enlarged sectional view of the exit end of the burner assembly used in FIG. 1.

Adjacent its exit end, burner assembly 12 includes two annular pipes which encircle central burner conduit or pipe 26 and create auxiliary passages for air flow. As shown in FIG. 5, spinning air pipe 27, concentric with burner pipe 26 and of slightly larger diameter, defines therewith a spinning air annular conduit 28. Concentrically positioned with burner pipe 26 and spinning air pipe 27 is a straight air pipe 29 of slightly larger diameter than spinning air pipe 27 which defines therewith a straight air annular conduit 31.

Figure 3:
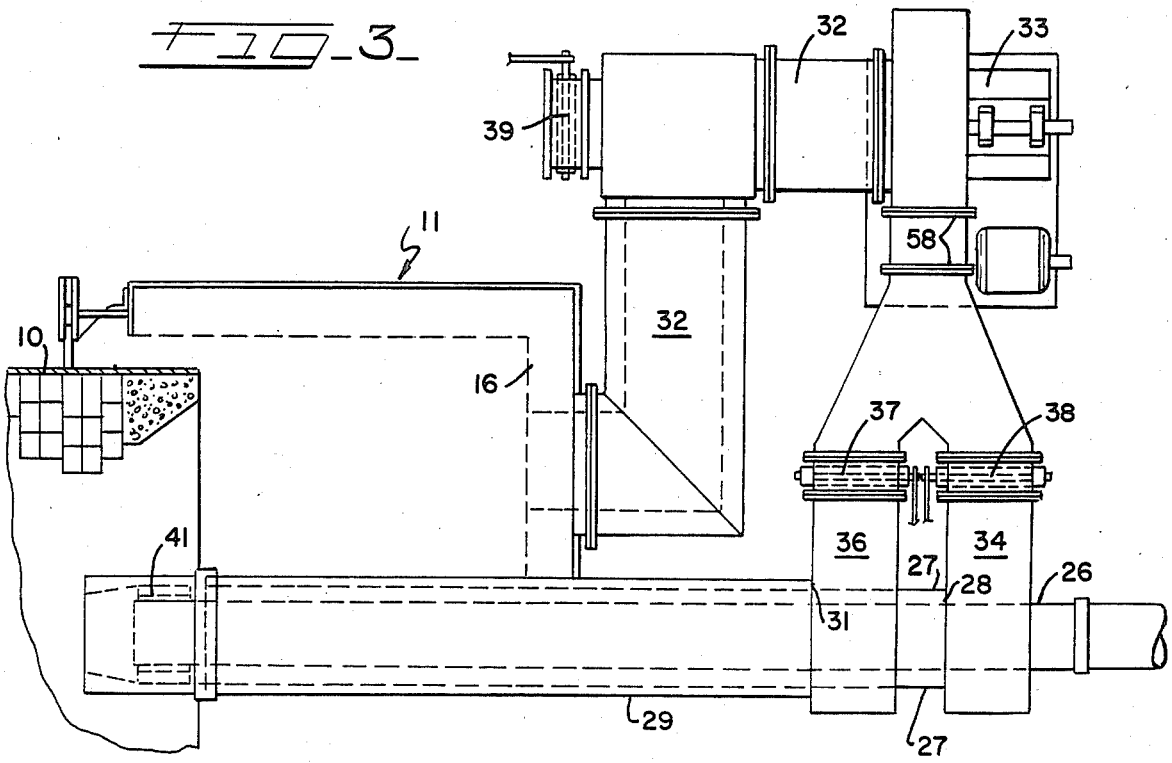
FIG. 3 is a plan view of a portion of the system of FIG. 1 showing the means for supplying heated secondary air to the burner pipe.

Spinning air and straight air conduits 28 and 31 respectively, can independently be supplied with heated secondary air in any desired quantities. This air is provided through secondary air conduit 32 through which heated air from within firing hood 11 is drawn by means of secondary fan 33 (FIG. 3). The heated air leaving secondary fan 33 is divided into separate streams which are conducted by spinning air feed conduit 34 and straight air feed conduit 36 into the inlets of the spinning air annular conduit 28 and straight air annular conduit 31, respectively. The relative quantities of straight and spinning air are controlled by means of dampers 37 and 38 which are independently controllable by means not shown to achieve the desired absolute and relative flow rates of straight and spinning secondary air.

Ambient air is admitted to the secondary air conduit 32 through secondary air damper 39 which is controlled by means not shown to maintain an appropriate temperature in the air supply to secondary air fan 33. This temperature is limited only by the thermal resistance of the associated equipment and may range up to about 700° F.

Adjacent the exit end of spinning air annular conduit 28 is a set of vanes 41 circumferentially spaced around the spinning air conduit and offset at an appropriate angle, suitably 15°-45°, to the direction of travel. These vanes impart a spinning motion to the air which emerges from the spinning air annular conduit 28 into the combustion zone 42 of kiln 10.

Straight air annular conduit 31 is not provided with such vanes, so that the air emerging therefrom tends to proceed in a straight line in the direction of its travel without any spinning motion.

It will be seen that the system of the invention permits independent control of the amounts and temperatures of primary air and secondary air streams supplied to burner pipe assembly 12. The temperature of the primary air, which carries the coal, is necessarily limited to avoid the possibility of premature combustion of the coal carried therein. The amount of primary air can be selected to achieve optimum performance of coal mill 17 as well as to transfer coal to the burner pipe assembly. The temperature of the air supplied through the spinning and straight annular conduits 28 and 31 is not so limited and can be chosen as desired. In addition, the relative volumes of straight and spinning secondary air can be controlled independently of the volume of primary air in which the coal is carried.

By suitably controlling these variables, the character of the flame 30 produced by burner assembly 12 can be varied as desired. For example, by having a relatively large amount of straight secondary air, the resulting flame can be made to be long and relatively narrow. By increasing the relative amount of spinning air, the flame can be made shorter but broader. Controlling the flame size and shape in this manner permits the location of the ash ring which builds up in a rotary kiln to be varied, thus preventing excessive build-up at any one location. In addition, the total amount of air supplied to the burning coal can be controlled to achieve a neutral condition, in which the theoretical stoichiometric quantity of oxygen is supplied, a reducing condition in which a deficiency of oxygen is present, or an oxidizing condition in which an excess of oxygen is present, as desired or required by the application in which the burner is used.

Another important feature of the combustion system of the invention is the ability, as desired, to add large quantitites of hot air into the coal rich stream as it is introduced into the combustion zone so that the pulverized coal particles can be heated to the point of breaking the carbon down to gaseous carbon monoxide. If this is done early enough in the flame zone, better mixing of carbon monoxide combustibles and oxygen can be anticipated well within the combustion zone, and therefore, more complete combustion will be obtained at low excess oxygen. This is a very important feature in lime kilns as well as other processes. Low excess oxygen is important in obtaining maximum fuel efficiency in any process or heating requirement, including steam boilers.

Figure 7:
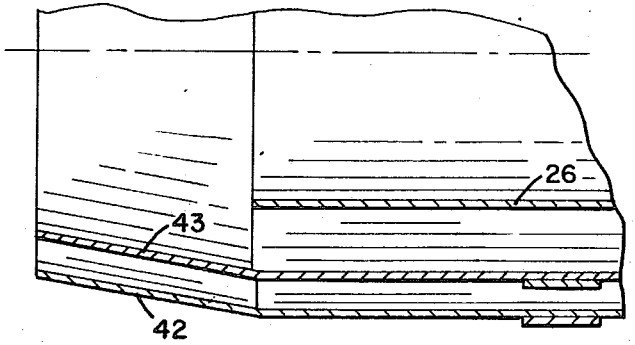
FIG. 7 is a partial sectional view of an alternative embodiment of the exit end of the burner assembly.

FIG. 7 illustrates a modified version of the exit end of the burner assembly in which straight air pipe 42 tapers inwardly to maintain a parallel relationship with spinning air pipe 43, rather than defining an outwardly flaring outlet as shown in FIG. 5. The construction shown in FIG. 7 has a somewhat greater tendency to direct the straight air inwardly as it emerges and therefore to achieve better mixing of secondary air and coal.

Figure 8:
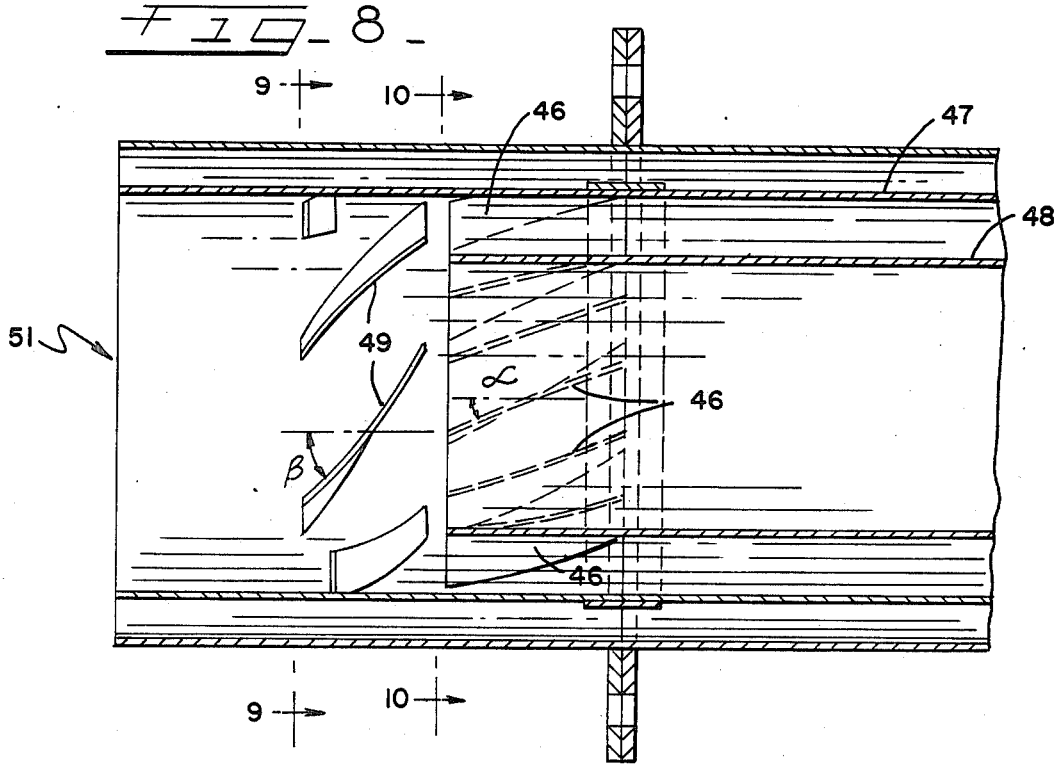
FIG. 8 is a sectional view of an alternative embodiment of the invention in which a double set of vanes is used at the exit end of the burner assembly for creating turbulence in the secondary air stream passing therethrough.
Figure 9:
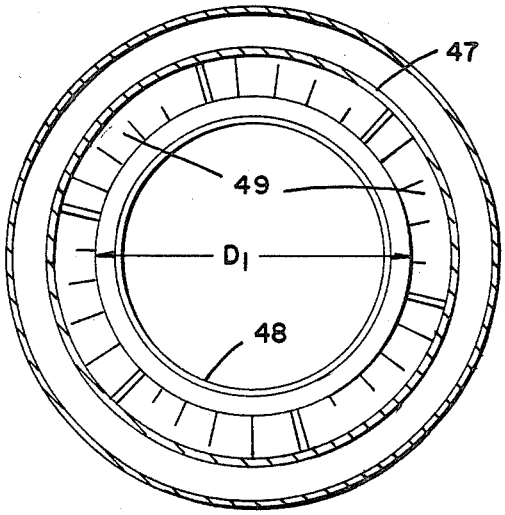
FIG. 9 is a sectional view along the line 9—9 of FIG. 8.
Figure 10:
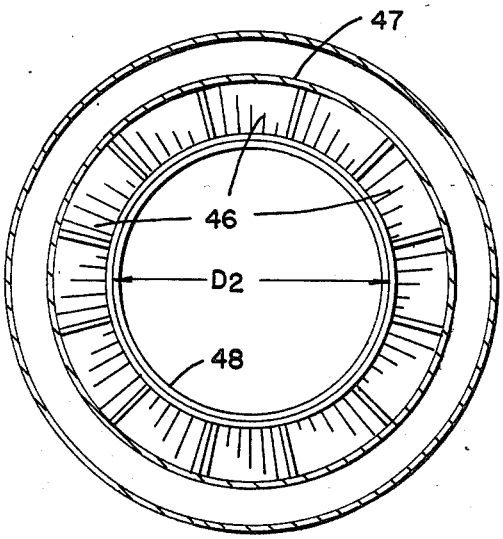
FIG. 10 is a sectional view along the line 10—10 of FIG. 8.

FIGS. 8–10 illustrate an alternative preferred embodiment of spinning means for creating turbulance in the secondary air stream. In this embodiment, two sets of spaced vanes are used. A first set of vanes 46 is similar to vanes 41 in FIG. 5, spanning the distance between spinning air pipe 47 and burner pipe 48. Like vanes 41, vane 46 are set at an oblique angle $\alpha$, suitably within the range of 20°–40° and preferably about 30°, to the direction of air flow.

Situated downstream of the exit end of burner pipe 48 is a second set of vanes 49, attached by their outer edges to pipe 47 and arranged at an angle $\beta$, which is greater than angle $\alpha$ and is suitably about 40°–60°. Because of their greater inclination, fewer vanes 49 relative to the number of vanes 46 are required for imparting turbulence to the air flow. The number of vanes 49 is suitably one-third to two-thirds, and preferably about one-half of the number of vanes 46.

Vanes 49 project radially inwardly a distance less than the inward projection of vanes 46. Accordingly, the diameter $D_1$ of the projected cylinder defined by the inner edges of vanes 49 is larger than the diameter $D_2$ of burner pipe 48. The cross-sectional area of the projected cylinder having the diameter $D_1$ is suitably 25% to 75% greater than the cross-sectional area of burner pipe 48.

The configuration shown in FIGS. 8–10 forces a portion of the spinning air exiting from pipe 47 to be mixed with the coal-rich mixture exiting from burner pipe 48 and also adds more spinning energy to the remaining air. As a result, a greater radial energy component is imparted to the entire coal-air mixture leaving burner assembly 51, as a result of which the longitudinal velocity of the coal/air mixture in the burning zone will be lowered, thereby increasing the retention time of the coal in the burning zone and the efficiency of combustion.

Figure 2:
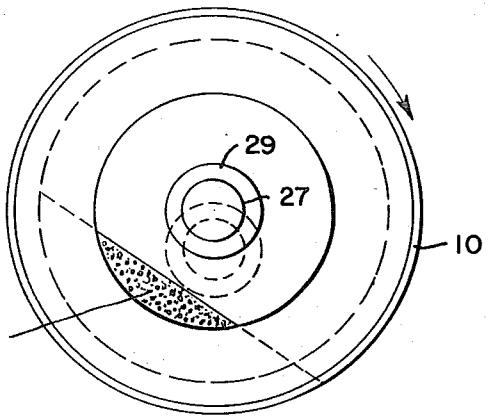
FIG. 2 is a cross-section along the line 2—2 of FIG. 1 of the exit end of the rotary kiln.
Figure 4:
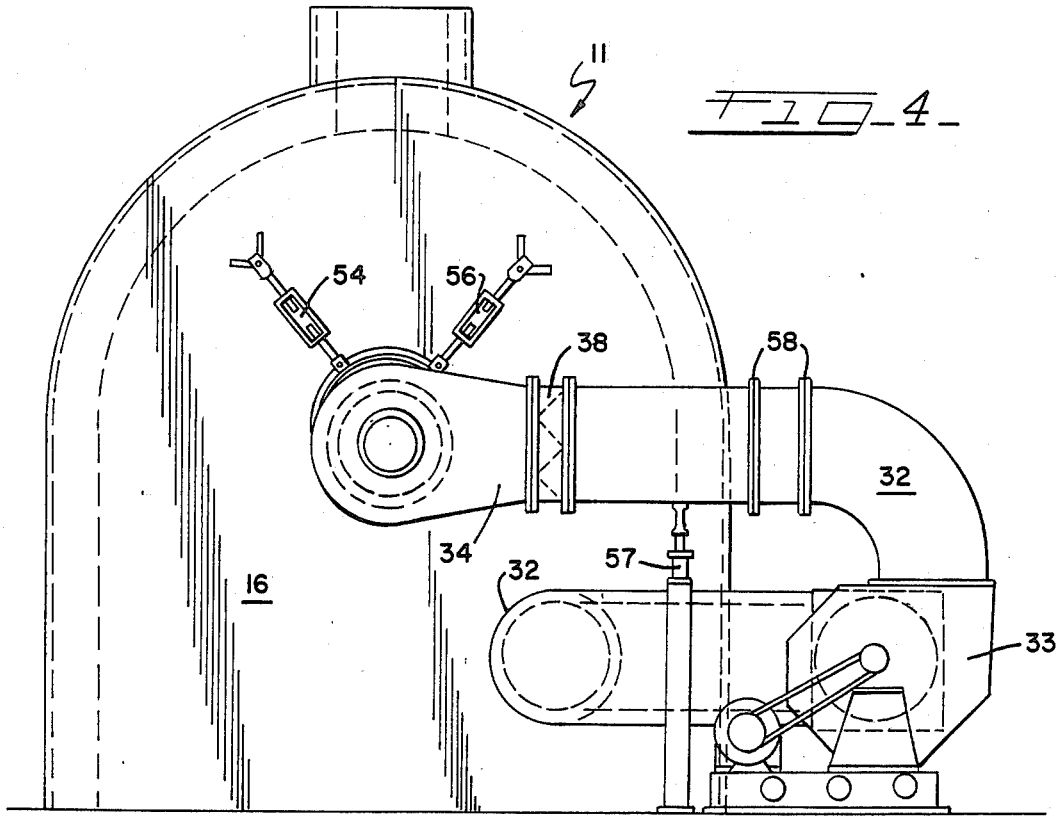
FIG. 4 is a sectional view along the line 4—4 of FIG. 1.
Figure 6:
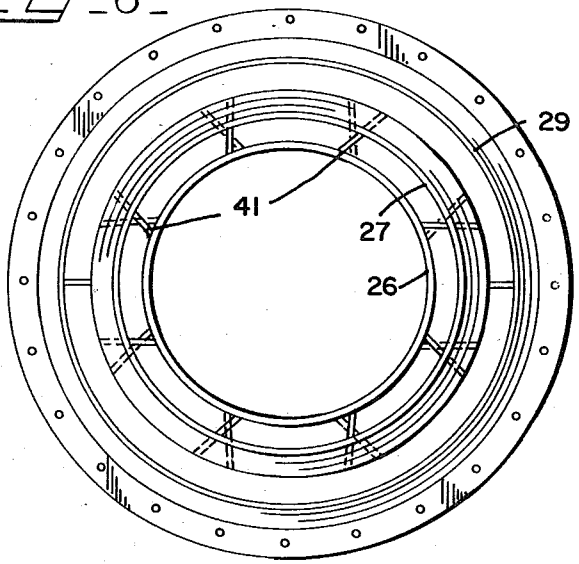
FIG. 6 is a view along the line 6—6 of FIG. 5.
Figure 11:
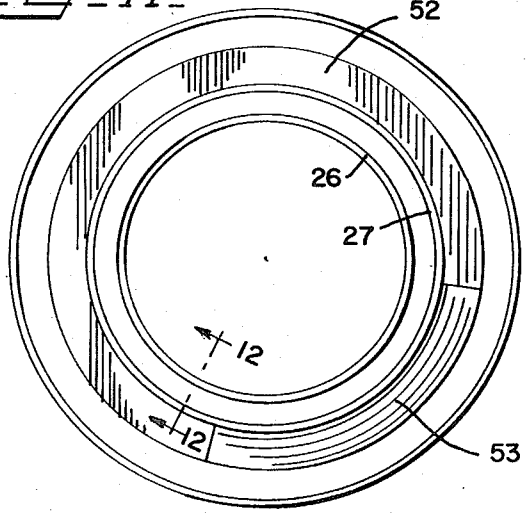
FIG. 11 is a view similar to FIG. 6 of the exit end of an embodiment of the burner assembly employing a partial baffle.
Figure 12:
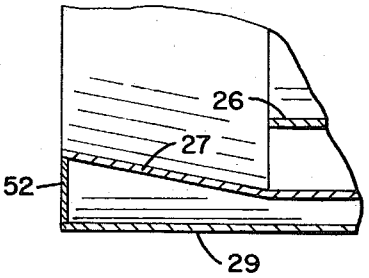
FIG. 12 is a sectional view along the line 12—12 of FIG. 11 showing the baffle in place.

Under some circumstances, it is advantageous to direct a flow of air between the material being heated in a rotary kiln and the flame which is supplying the heat. As shown in FIG. 2, because of the rotation of the kiln, the product 13 tends to assume an off-center location. In order to direct a stream of air across the surface of the material being heated, thereby reducing the carbon dioxide content of the atmosphere in this region and thus the efficiency of calcination, a baffle 52 (FIG. 11) can be fitted across the exit end of burner pipe assembly 12 to cover the straight air annular conduit 31 except in an appropriately oriented portion 53. Straight air emerging from the uncovered portion of the annular conduit will then sweep across the product between the flame and the surface thereof, thereby improving the efficiency of the heat treatment. For the same reason, burner pipe assembly 12 is supported at its point of entry into firing hood 11 (FIG. 4) by a pair of turnbuckles 54, 56 and a screw jack 57 which permits the vertical and horizontal location of the burner pipe to be adjusted within limits. The double-acting expansion joints 58 through which burner pipe assembly 12 is connected to the secondary air feed system are sufficiently flexible to permit this adjustment to be made.

Although the present invention has been described with reference to burning pulverized coal as the solid fuel, it will be understood that other finely divided solid fuel particles, e.g., coke produced from coal or petroleum, could also be used. The term "coal" as used herein and in the appended claims is intended to include such other fuels. Further, the use of this invention is not limited to rotary kilns, but can also be adapted to any combustion chamber to improve efficiency and control of the combustion process.

The foregoing detailed description has been given for clearness of understanding only, and no unnecessary limitations should be understood therefrom as modifications will be obvious to those skilled in the art.

What is claimed is:

1. A coal combustiom system comprising:

a combustion chamber;

an elongated burner pipe assembly having an inlet end and an exit end, said exit end being adapted to emit finely divided ooal and combustion air into said combustion said burner pipe being divided longitudinally into at least two conduits including a central conduit and a concentric first outer annular conduit, the outlet end of said first annular conduit zone being equipped with spinner means for imparting turbulence to an airstream passing therethrough, said spinner means comprising a plurality of vanes adjacent the exit end of said first annular conduit, and arranged at an oblique angle to the direction of airflow therein.

said vanes being arranged in two sets, a first set within said first annular conduit and a second set downstream of the first set and beyond the exit end of said central conduit, the vanes of said second set being attached at their outer edges to said second annular conduit and projecting radially inwardly.

the vanes of said second set being fewer in number than the vanes of said first set and being arranged at an oblique angle which is larger than the oblique angle at which the vanes of said first set are arranged.

the inner edges of the vanes of said second set falling on a projected cylinder having a cross-sectional area larger than the cross-sectional area of said central conduit.

means for supplying finely divided coal suspended in a first stream of air to the inlet end of said central conduit;

means for supplying a second stream of air to the inlet end of said first annular conduit; and means for heating said second stream of air.

2. A system in accordance with claim 1 wherein said combustion chamber is a rotary kiln.

3. A system in accordance with claim 1 wherein the cross-sectional area of said projected cylinder is 25–75% larger than the cross-sectional area of said central conduit.

4. A system in accordance with claim 1 further including:

a second concentric annular conduit for air flow in said burner pipe, said second conduit being adjacent to said first annular conduit and means for controlling the amount and temperature of air supplied to said second annular conduit.

5. A system in accordance with claim 2 wherein said burner pipe assembly is provided with a baffle which partially blocks the outlet of said second annular conduit.

6. A coal combustion system comprising:

a combustion chamber;

an elongated burner pipe assembly having an inlet end and an exit end, said exit end being adapted to emit finely divided coal and combustion air into said combustion chamber;

said burner pipe being divided longitudinally into at least two conduits including a central conduit and a concentric first outer annular conduit, the outlet end of said first annular conduit zone being equipped with spinner means for imparting turbulence to an airstream passing therethrough;

a second concentric annular conduit for air flow in said burner pipe, said second conduit being adjacent to said first annular conduit;

a baffle for partially blocking the outlet of said second annular conduit;

means for supplying finely divided coal suspended in a first stream of air to the inlet end of said central conduit;

means for supplying a second steam of air to the inlet end of said first annular conduit;

means for heating said second stream of air; and means for controlling the amount and temperature of air supplied to said second annular conduit.

* * * * *